United States Patent [19]

Stefan

[11] Patent Number: 4,919,228

[45] Date of Patent: Apr. 24, 1990

[54] RESCUE SYSTEM FOR TALL BUILDINGS

[76] Inventor: Alexander Stefan, 216 E. Arby Ave., Las Vegas, Nev. 89119

[21] Appl. No.: 296,932

[22] Filed: Jan. 13, 1989

[51] Int. Cl.[5] ..... A62B 1/02

[52] U.S. Cl. ..... 182/14; 182/47; 182/142

[58] Field of Search ..... 182/142, 143, 144, 150, 182/47, 12, 13, 14

[56] References Cited

U.S. PATENT DOCUMENTS

| | | | |
|---|---|---|---|
| 400,121 | 3/1889 | Schaefer | 182/142 |
| 414,476 | 11/1889 | Allgrove | 182/142 |
| 581,197 | 4/1897 | Cook | 182/142 |
| 735,484 | 8/1903 | Evene | 182/12 |
| 770,808 | 9/1904 | Iron | 182/47 |
| 773,000 | 10/1904 | Canfield | 182/12 |
| 1,027,724 | 5/1912 | Haney | 182/142 |
| 2,190,093 | 2/1940 | Bossart | 182/144 |
| 4,355,699 | 10/1982 | Smith | 182/142 |
| 4,406,351 | 9/1983 | Littlejohn | 182/142 |

*Primary Examiner*—Reinaldo P. Machado
*Attorney, Agent, or Firm*—Charles C. Corbin

[57] ABSTRACT

System for rescuing occupants of a tall building having at least one generally planar windowed face is disclosed, which system includes a first and a second boom mounted respectively at opposite sides of the building face at a building level above that face. Each boom has a retracted position and is shiftable to a cantilevered position in which its outer end overhangs the side of the building. A first and a second hoist cable extends respectively from the outer ends of the booms. A rescue cage has a top, a bottom and a flexible, collapsible, heat-shielding wall extending between the peripheries of the top and bottom to provide a shielded compartment. A pair of hoists are mounted to the cage top and engage individually the first and second hoist cables in order to drivingly support the cage adjacent the building face. The hoists are controllable so as to be driven differentially to move the cage transversely of the building face, and driven in the same direction for vertical motion. The cage is vertically collapsible to a compact configuration in which the top and bottom are in close proximity with the flexible wall portion folded therebetween.

15 Claims, 3 Drawing Sheets

Fig. 4
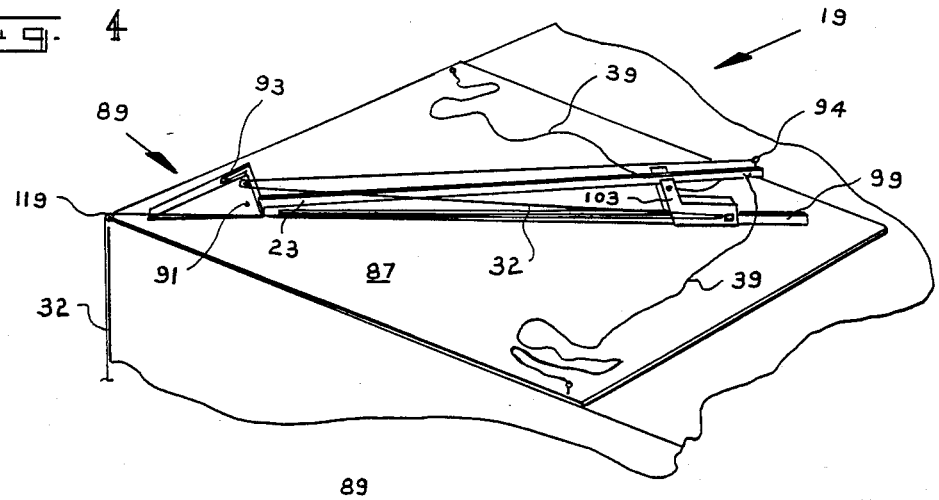
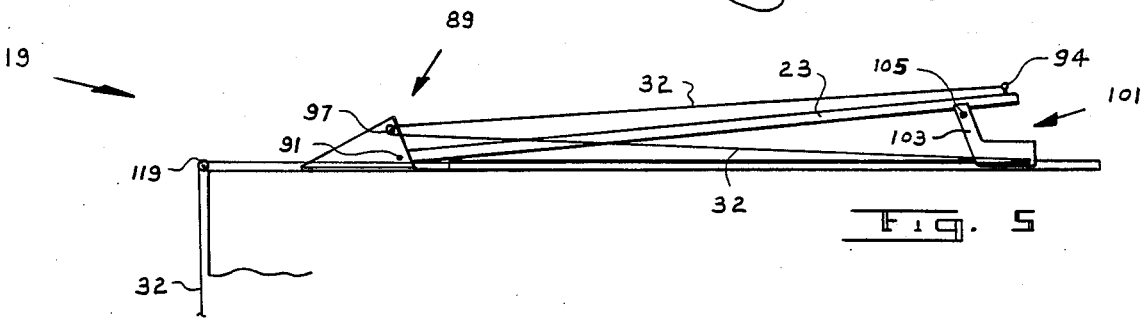
Fig. 5
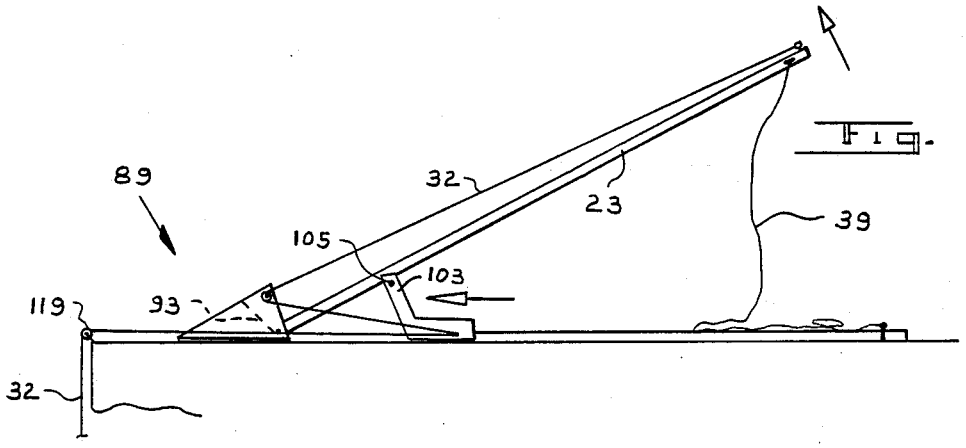
Fig. 6
Fig. 7
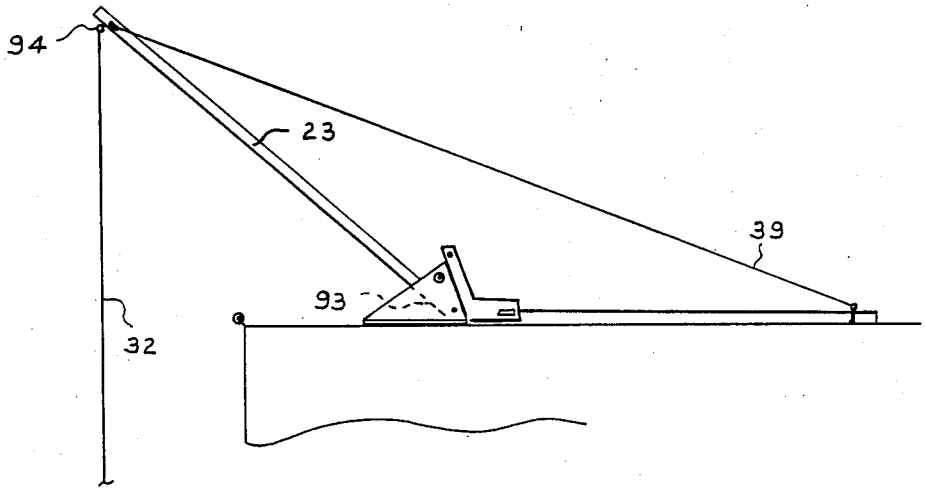

RESCUE SYSTEM FOR TALL BUILDINGS

BACKGROUND

1. Field of the Invention

This invention relates to apparatus and system for rescuing occupants of a tall building. More particularly this invention relates to a rescue system that uses a rescue cage maneuverably suspended by cables adjacent a face of a tall building.

2. Prior Art

Many advancements have been made in ways to protect occupants of tall buildings from the hazard of fire. For example, most tall buildings commonly have fire suppression systems such as sprinkler systems. New constructions incorporate fire resistant, noncombustible materials and use fire doors and shielded fire escape staircases. Modern designs also include extensive use of smoke detectors and alarms.

Despite the provisions of such safeguards on a widespread basis there remains a need to address the special concerns of occupants of tall buildings. Fires can occur, and propogate, through human error and the failure of detection, suppression and/or alarm systems. Unfortunately, in a tall building, out-of-control fire can cause occupants to be stranded in a room when normal escape routes are cut off by heat, fire and/or fumes. For such people the only avenue of escape is by evacuation through a window. Unfortunately the reach of conventional firetruck ladders limits rescue attempts to the lower floors of a building, and this inadequacy is extensive in view of the relatively large numbers of tall buildings that exist. Even where windows are accessible by extension ladder the speed and effectiveness of rescue is hampered by the limited numbers of people that can be evacuated at one time, especially when an evacuee must be carefully assisted down the steps of the ladder. In addition, vertical repositioning of the top of the ladder is not speedy and to make a lateral change requires the ladder support vehicle to be moved. Helicopters have been used for evacuation from a roof top, however, rescue helicopters are not extensively available and their ability to extricate people from the windows of a building is greatly limited.

SUMMARY OF THE INVENTION

In view of the aforestated drawbacks and limitations it is a general objective of the present invention to provide a resuce system for tall buildings which overcome these shortcomings.

A particular object of the present invention is to provide an evacuation system by which a person stranded in a windowed room at any level of a tall building may be rescued.

Another object of the invention is to provide a quickly deployable resuce system for a tall building.

A further object is to provide a resuce system that can shift focus quickly from one window location of a tall building to another window location.

A still further object is to provide a tall building rescue system that can handle a plurality of evacuees per rescue attempt.

Another object is to provide rescue apparatus which shields evacuees from heat and flame.

Yet another object is to provide rescue apparatus that has an unobtrusive and compact stow configuration.

Accordingly these and other objects and advantages are achievable by the inventive system of the present invention which achieves the aforestated objectives and additional advantages by providing a rescue system that includes roof-mounted booms, one of each located at opposite sides of a generally planar face of a building. Each boom is shiftable from a retracted position to an operational position in which its outer end is extended somewhat beyond the face of the building. A first hoist cable extends from the outer end of a first boom and a second hoist cable extends from a second boom.

In a preferred embodiment there are means by which rescue personnel at ground level may cause deployment of booms. The invention features a collapsible protective rescue cage having a top wall to which is mounted means for engaging the first and second hoist cables, and the cage includes at least one lower wall or floor which is connected to the top by a plurality of flexible elongate support members extending from the periphery of the top wall to the periphery of the at least one lower wall. There is a flexible and collapsible heat-shielding side wall also extending from the periphery of the top to the periphery of the at least one lower wall. The cage has an operational configuration in which it is suspended upon the first and second cables adjacent the face of the building, and in which configuration the at least one lower wall lies parallel to and below the top wall, and the side wall serves to form a compartment that can shield occupants from heat and flame. The cage includes a doorway, equipped with a flexible heat retarding curtain.

The cage may be quickly transformed to a compact configuration for storage and transportation in which configuration the top wall is brought into close proximity to the lower wall with the support members and flexible side wall lying folded therebetween. Finally the inventive system includes cable drive means and associated control means for selectively shortening or lengthening the first and second hoist cables such that the suspended cage is manueverable vertically, transversely and obliquely across the face of the building.

BRIEF DESCRIPTION OF THE DRAWINGS

FIG. 4 is a perspective view illustrating a boom assembly of the inventive system in its retracted configuration;

FIG. 5 is a side elevational view of a boom assembly;

FIG. 6 is a similar view to FIG. 5 and illustrating the raising of a boom;

FIG. 7 is a side elevational view showing the boom of FIG. 6 in operational position;

DETAILED DESCRIPTION OF THE INVENTION

Figure 1:
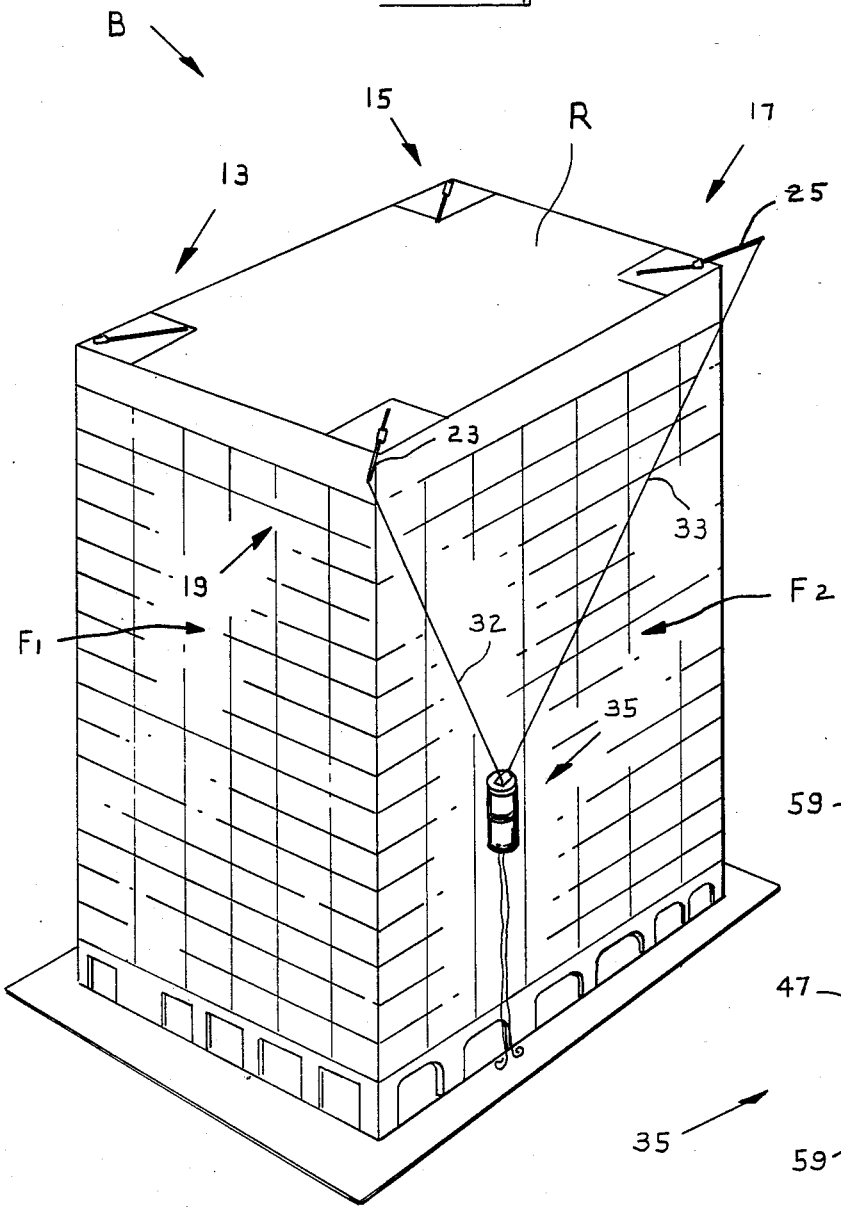
FIG. 1 is a perspective view of a building on which is deployed a rescue sysstem according to the present invention.

FIG. 1 illustrates an embodiment of the inventive rescue system applied to a building B that has a fairly large number of floor levels and has building faces F1 and F2. It will be appreciated that the present system is deployable on any number of generally planar faces of a building and the present example shows boom assemblies 13, 15, 17 and 19 mounted at corner regions of roof F to serve all four faces of building B. Here the assemblies 13 and 15 are in retracted configurations while assemblies 17 and 19 are in operational configurations for operation along building face F2, in which configurations their booms 23 and 25 are extended in cantilever fashion with hoist cables 32 and 33 extending therefrom respectively, to a rescue cage 35. Note that by mounting the boom assemblies near the corners of adjoining building faces a single boom assembly may serve the adjoining building faces. Thus in our example the assembly 19 is used in conjunction with boom assembly 17, and it is also available for use with the assembly 13 should it be desirable to deploy a rescue cage adjacent the building face F1. As FIG. 1 suggests, it is preferable that in such multi-face applications that a cantilevered boom extends in a direction which bisects the angle between adjoining building faces.

FIGS. 1 and 7 illustrate that boom 23, which has been shifted to its operative position in a manner to be discussed hereinafter, is provided additional lateral support to its outer end by the use of guy lines 39.

Figure 2:
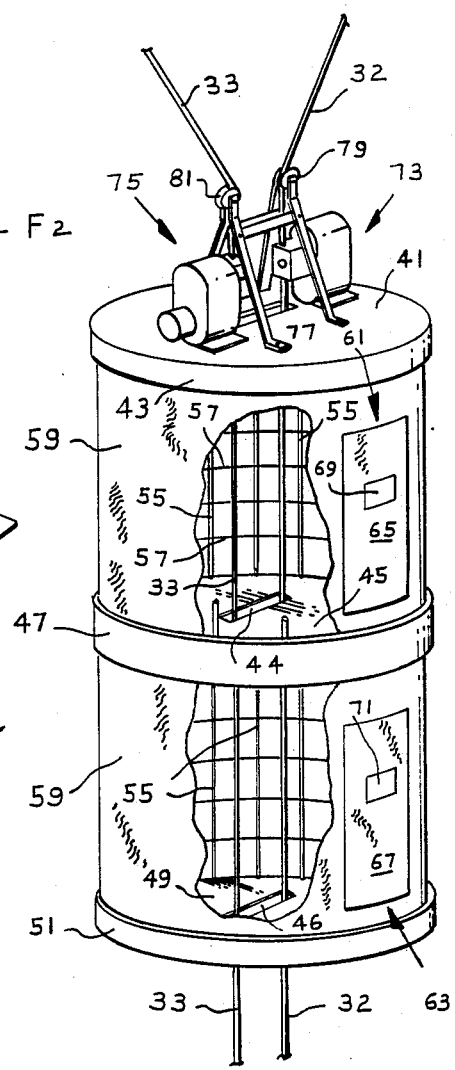
FIG. 2 is a perspective view showing a two compartment rescue cage used in a rescue system according to the present invention, and with parts broken away for the sake of clarity.

FIG. 2 shows the rescue cage 35 to include a rigid top 41 having a peripheral downwardly extending ring portion 43. Spaced a preselected distance below top 41 is a middle floor 45 which has a peripheral ring 47, and a bottom floor 49 with its ring portion 51. It will be appreciated that the spacing between cage floors is selected to approximate the interfloor distance of building B so as to provide cage 35 with the ability to service two floor levels at one time, and to increase the overall holding capacity of the system. The cage top and floors are preferably constructed of heat resistant, non-flammable materials. A multitude of flexible cables 55 extend down from the peripheral region of top 41 and are affixed by suitable means to peripheral regions of middle floor 45 and bottom 49 so as to vertically support these floors. Cables 55 are preferably of high strength steel alloy, and sufficiently thin and flexible so as to be easily foldable in a manner to accommodate the collapsed configuration of cage 35 which will be described later by reference to FIG. 3. Lightweight horizontal cables 57 interconnect with support cables 55 and provide additional structural integrity to cage 35. A protective enclosure designed to shield occupants of cage 35 from heat and flame is provided by a flexible wall 59 of sheet material which preferably has an outer reflective layer whic covers a heat resistant insulative material such as an asbestos weave or equivalent material. If asbestos is used than an additional inner layer is provided to isolate it from the inside environment of cage 35. The curtain-like flexible wall 59 lies just outside support members 55 and within the ring portions 43, 47 and 51. Access to the compartments of cage 35 is via doorways 61 and 63 which are provided with protective curtains 65 and 67 respectively. Each curtain is composed of the same flexible material used in wall 59 and is suspended at its top end and may be urged inwardly and aside to pass people. Note that each curtain has a heat resistant viewport 69 and 71 respectively. The doorways 61 and 63 are located on the side of cage 35 which faces the building face F2 and the viewports allow an occupant/operator of cage 35 to view the building face as the cage is maneuvered therealong in a manner to be described.

A first and second cable hoist 73 and 75 are mounted to top 41 and are of a conventional design by which the hoist cables 32 and 33 may be easily attached into drive relationship. These hoists preferably have electric motors powered by self-contained battery power packs, or by an electrical supply line that can extend to a ground based power source. Other embodiments may employ an on-board, internal-combustion engine powered generator. A pulley support bracket 77 holds guide pulleys 79 and 81 in proper alignment above hoists 73 and 75 respectively, and feed the cables vertically to each hoist. Note the floor openings at 44 and 46 which allow for downward passage of hoist cables 73 and 75. Control means for the drives of hoists 73 and 75 may be in the form of switches (not shown) located in the lower compartment of cage 35. The hoists may also be remotely controlled by way of electrical cble extending to a control module at ground level or by an electronic link with ground control; all of conventional design.

When cage 35 is suspended as illustrated in FIGS. 1 and 2, it can be maneuvered laterally, vertically and obliquely about the building face by selectively controlling the driving of hoists 73 and 75. By drawing in and playing out cables 32 and 33 the cage 35 may be raised or lowered. By driving the winches differentially, lateral motion is achieved. This differential driving includes driving the hoists in opposite directions as well as in the same direction at different speeds where speed variation is provided.

Figure 3:
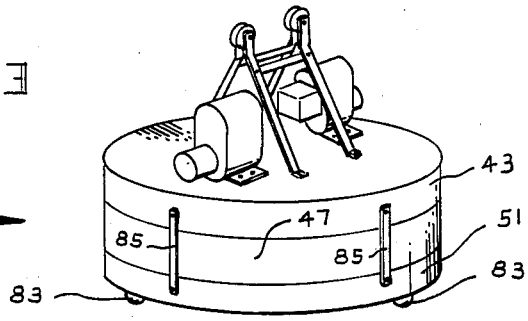
FIG. 3 is a perspective view showing the cage of FIG. 2 in its collapsed configuration.

The collapsed, folded configuration of cage 35 shown in FIG. 3 can be quickly achieved when the bottom floor 49 is touching ground (via caster wheels 83) and the top 41 is lowered towards bottom 49. During this process the lower edge of middle ring 47 moves towards engagement with the upper edge of bottom ring 51 as the flexible wall 59 and support cables 55 are manipulated and folded into the space between rings 47 and 51. The wall and support structures of the upper compartment may be similarly folded into the space between top ring 43 and the middle ring 47 as these rings are moved into engagement with each other. Various means, such as latches 85 may then be used to hold cage 35 in the folded configuration shown in FIG. 3. With cables 33 and 33 deteached, the compact cage may be moved by rescue personnel on and off its transport vehicle and to a storage location as required.

The boom assembly 19 shown in FIGS. 4 and 5 includes a base plate 87 that is secured at a corner of roof F. Boom support 89 is affixed to plate 87 and pivotally mounts one end of boom 23 for rotation about the horizontal pin 91. Support 89 provides a support ledge at 93, which is designed to limit the outward rotation of boom 23 and hold it in its cantilevered position shown in FIGS. 1 and 7. The hoist and boom-deploying cable 32 is secured at the outer end 94 of boom 23. Support 89 also provides a tripping cam 95, shown in FIG. 9, and mounts a pulley wheel 97. Guide track 99 is affixed to plate 87 and receives a boom-deploying dolly 101 for sliding movement therealong. The spaced apart ends 103 of dolly 101 support a horizontal prop bar 105 upon which slidably rests the underside of boom 23.

Figure 8:
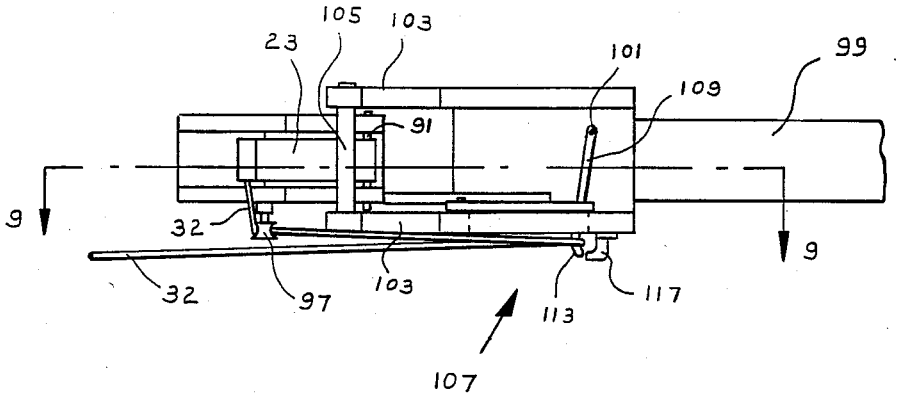
FIG. 8 is a partial, top plan view of a boom dolly.

FIG. 8 shows that dolly 101 has a cable guide and release mechanism 107 that includes lever 109 that is pivotally mounted about vertical pin 111. Lever 109 has the latched position as shown in which it extends through slot 115 with its outer end portion 113 cooperating with a fixed projection 117 to releaseably retain and slidably receive passage of the deploy and hoist cable 32. At the outer edge of mounting plate 87 is mounted another pulley 119. Thus when boom 23 lies in the retracted position the cable 32 extends from location 94, around pulley 97 and lever portion 113, around pulley 119 and downwards to ground level. The suspended weight of cable 32 generates sufficient tension to hold cable 32 fairly taut but not enough to move the dolly 101. However, the dolly 101 may be cause to move along the track 99 when cable 32, from ground level, is pulled downwardly with a certain force. In this regard it will be appreciated that the aforesaid cable routing will provide the mechanical advantage of a single sheave block-and-tackle.

Figure 9:
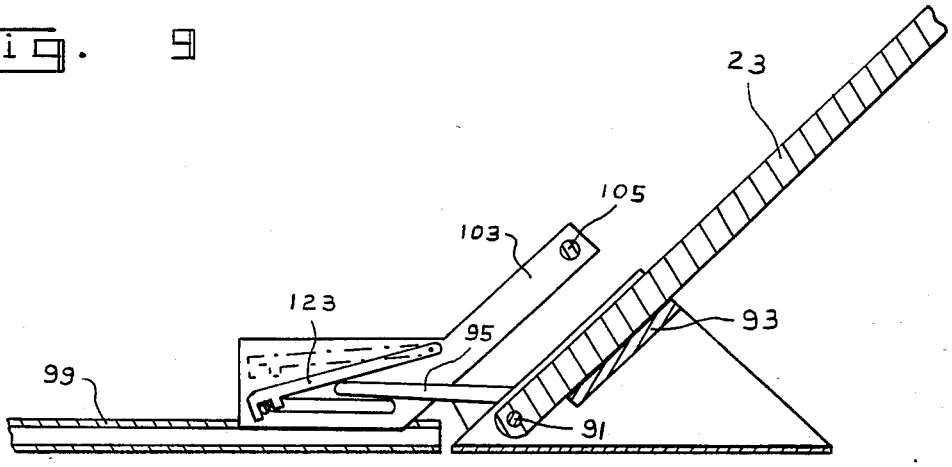
FIG. 9 is a sectional view taken along the line 9—9 of FIG. 8.

As FIG. 6 illustrates, as the dolly 101 is moved towards the boom support 89, the prop bar 105 slidingly urges the boom 23 to rotate upwardly. When boom 23 is moved past a vertical position, gravity will urge it towards holding engagement with the support ledge 93. During this process the release mechanism will be tripped to unlatch the lever 109 which frees cable 32 to hang directly from boom end 94. FIG. 9 shows this to occur when the pivotable latch 123 is turned by virtue of engagement with the tripping cam 95. Thus the rooftop booms of the present rescue system are quickly deployable by ground-based personnel.

In an example of the operation of the aforedescribed system on building B, the booms 23 and 25 are deployed when cables 32 and 33 are pulled downwardly as described. Cage 35, in its compact configuration may then be moved into position on the ground, adjacent building face F2, and cables 32 and 33 attached to hoists 73 and 75. The cage 35 is then hoisted into its operative configuration shown in FIG. 2. Cage 35 may then be driven, as described before, vertically and transversely as desired across building face F2 and positioned at various window "docking" sites to affect rescue of building occupants therethrough. Thus in previously unattainable fashion, the ability to evacuate stranded occupants from all floor levels of a building is provided.

A preferred embodiment has been described and it shall be appreciated by those with ordinary skill in the art, that within the scope of the invention, various changes may be made. For example, the rescue cage may have a generally rectangular configuration rather than the cylindrical shape herein described. Thus it is aimed to cover all changes and modifications as fall with the true spirit and scope of the invention.

What is claimed is:

1. System for rescuing occupants of a tall building, which building has at least a first generally planer face, said system comprising:

(a) at least a first and second boom, each mounted at an upper level of said building at opposite sides of said first building face and each being movable from a retracted position to an operative position with its outer end spaced outwardly of said first building face;

(b) a first hoist cable extending downwardly from the outer end of said operative first boom and a second hoist cable extending downwardly from the outer end of said operative second boom;

(c) collapsible, protective cage having a top wall to which is mounted means for engaging said first and second hoist cables, said cage including at least a first lower wall joined to said top wall by a plurality of flexible elongate support members extending from the periphery of said top wall to the periphery of said at least first lower wall, and flexible, heat-resistant material extending from the periphery of said top wall to the periphery of said at least first lower wall, said cage having an operational configuration in which it is suspended adjacent said building face by said first and second cables and in which said support members and flexible material are extended and said at least first lower wall lies spaced parallel to and below said top wall so as to define a heat-shielded compartment, said extended material having a collapsible doorway therein; and said cage having a collapsed configuration in which said top and said at least first lower wall lie in close proximity with said support members and flexible materials collapsed therebetween; and (d) cable driving means for varying the extended lengths of said first and second hoist cables whereby said cage is maneuverable laterally, vertically and obliquely across said building face.

2. System as defined in claim 1 wherein said cable driving means comprises first and second hoist means mounted to said cage top wall for engaging in drive relationship respectively said first and second hoist cables, said hoists being individually controllable to pull in and play out said cables.

3. System as defined in claim 2 wherein the speed at which said first and second hoist means drive said first and second cables in variable.

4. System as defined in claim 1 wherein said doorway comprises a flexible heat resistant curtain mounted at an opening in said flexible material.

5. System as defined in claim 1 wherein said cage has a generally cylindrical configuration.

6. System as defined in claim 1 wherein said cage has a generally rectangular configuration.

7. System as defined in claim 1 wherein said cable driving means comprises first and second hoist means for driving respectively said first and second hoist cables, and mounted to said upper part of said building.

8. System as defined in claim 1 including a transparent view port in said cage.

9. System as defined in claim 2 wherein control means for said hoists are locatable within said cage compartment.

10. System as defined in claim 2 including remote control means for said hoists that is linked with said hoists by electromagnetic signals.

11. System according to claim 1 wherein said cage in operational configuration has a first lowe wall and a second lower wall, and said first wall being spaced below said first wall by a distance that approximates the spacing between adjoining floors of said building.

12. System for rescuing occupants of a tall building, which building has at least a first generally planar face, said system comprising:

(a) at least a first and second boom, each mounted at an upper level of said building at opposite sides of said first building face and each being moveable from a retracted position to a cantilevered operational position with an outer end spaced outwardly of said at least first building face;

(b) a first hoist cable affixed to said other end of said first boom and a second hoist cable affixed to the other end of said second boom;

(c) rescue cage having top, bottom and side walls that form a barrier to the passage of heat into said cage, and first and second hoist means mounted to said top wall for engaging in drive relationship respectively said first and second cables, whereby said hoist means is controllable to drive said first and second cables differentially to achieve generally lateral motion of said cage across said building face and to pull or play out said cables simultaneously to achieve vertical motion of said cage; means releaseably engaged by upper portions of said first and second cables when said first and second boom are in retracted position whereby a certain downward force on each of said cables generated at ground level, will cause said first and second boom to be urged into its cantilevered position and the release of said upper cable portions.

13. System as defined in claim 12 wherein one end of each said first and second booms is pivotally mounted about a horizontal axis.

14. System as defined in claim 12 wherein said first and second booms are each mounted to means for slidably supporting it to move in a generally horizontal line from retracted position to cantilevered position.

15. System as defined in claim 13 including a horizontally extending track, a dolly slidably mounted for movement along said track towards said one end of said boom and said dolly adapted to slidably support said boom and engaged by said upper portion of said cable such that said downward pulling urges said dolly in motion during which motion said dolly pushes said boom to rotate to its cantilevered position.

* * * * *